US010520227B2

(12) United States Patent
Yates et al.

(10) Patent No.: US 10,520,227 B2
(45) Date of Patent: Dec. 31, 2019

(54) PULSE TUBE CRYOCOOLER WITH AXIALLY-ALIGNED COMPONENTS

(71) Applicant: Raytheon Company, Waltham, MA (US)

(72) Inventors: Ryan Yates, Los Angeles, CA (US); Theodore J. Conrad, Redondo Beach, CA (US); Brian R. Schaefer, Huntington Beach, CA (US)

(73) Assignee: Raytheon Company, Waltham, MA (US)

( * ) Notice: Subject to any disclaimer, the term of this patent is extended or adjusted under 35 U.S.C. 154(b) by 126 days.

(21) Appl. No.: 15/698,940

(22) Filed: Sep. 8, 2017

(65) Prior Publication Data

US 2019/0078814 A1 Mar. 14, 2019

(51) Int. Cl.
*F25B 9/14* (2006.01)
*F25B 9/10* (2006.01)

(52) U.S. Cl.
CPC ..... *F25B 9/145* (2013.01); *F25B 9/10* (2013.01); *F25B 2309/001* (2013.01); *F25B 2309/1406* (2013.01); *F25B 2309/1407* (2013.01); *F25B 2309/1408* (2013.01); *F25B 2309/1414* (2013.01); *F25B 2309/1423* (2013.01)

(58) Field of Classification Search
CPC .... F25B 9/00; F25B 9/14; F25B 9/145; F25B 2309/001; F25B 2309/1406; F25B 2309/1407; F25B 2309/1413; F25B 2309/1423
See application file for complete search history.

(56) References Cited

U.S. PATENT DOCUMENTS 4,365,982 A * 12/1982 Durenec ..... F25B 9/14 62/6
5,245,830 A * 9/1993 Aubrun ..... F25B 9/14 318/561

(Continued)

FOREIGN PATENT DOCUMENTS

CN 103344061 B 3/2015
JP H06-185817 A 7/1994

OTHER PUBLICATIONS

"Pulse tube refrigerator" from Wikipedia, https://en.wikipedia.org/wiki/Pulse_tube_refrigerator, downloaded from Internet, Sep. 2017.

(Continued)

*Primary Examiner* — Edward F Landrum
*Assistant Examiner* — Daniel C Comings
(74) *Attorney, Agent, or Firm* — Renner, Otto, Boisselle & Sklar, LLP

(57) ABSTRACT

A pulse-tube cryocooler includes a compressor piston that is axially aligned with a pulse tube. The compressor piston is an annular piston that has a central hole around its axis. An inertance tube, connected to one end of the pulse tube, runs through the central hole in the compressor piston. The cryocooler also includes a balancer that moves in opposition to the compressor piston, to offset the forces in moving the compressor piston. The balancer may also be axially aligned with the pulse tube, the annular piston, and the inertance tube. The alignment of the compressor piston, the pulse tube, and the inertance tube aligns the forces produced by movement of fluid within the cryocooler.

17 Claims, 2 Drawing Sheets

(56) References Cited

U.S. PATENT DOCUMENTS

| | | | | |
|---|---|---|---|---|
| 5,655,376 | A * | 8/1997 | Price | F25B 9/14 62/6 |
| 6,199,381 | B1 | 3/2001 | Unger et al. | |
| 6,467,276 | B2 * | 10/2002 | Chung | F02G 1/0435 60/520 |
| 7,296,418 | B2 | 11/2007 | Kirkeonnell et al. | |
| 8,015,831 | B2 | 9/2011 | Bellis et al. | |
| 2010/0313577 | A1 | 12/2010 | Kirkconnell et al. | |
| 2014/0202172 | A1 | 7/2014 | Kim | |
| 2014/0325999 | A1 | 11/2014 | Hope | |
| 2015/0041619 | A1 | 2/2015 | Ellis et al. | |
| 2015/0362221 | A1 | 12/2015 | Yates et al. | |

OTHER PUBLICATIONS

International Search Report and Written Opinion for corresponding International Application No. PCT/US2018/027420 dated Aug. 10, 2018.

* cited by examiner

PULSE TUBE CRYOCOOLER WITH AXIALLY-ALIGNED COMPONENTS

FIELD OF THE INVENTION

This disclosure relates generally to the field of pulse tube cryocoolers.

DESCRIPTION OF THE RELATED ART

For certain applications, such as space infrared sensor systems, a cryogenic cooling subsystem is required to achieve improved sensor performance. Numerous types of cryogenic cooling subsystems are known in the art, each having a relatively strong attributes relative to the other types. Stirling and pulse-tube linear cryocoolers are typically used to cool various sensors and focal plane arrays in military, commercial, and laboratory applications. Both types of cryocoolers use a linear-oscillating compressor to convert electrical power to thermodynamic pressure-volume power.

The moving parts of such cooling systems produce vibrations, as does the movement of working gas within such systems. Compensating for such vibrations may be difficult and involve expensive, complicated isolation systems to reduce forces in all directions in which they occur, which increases costs and weight of the cryocooler systems.

SUMMARY OF THE INVENTION

A cryocooler has components mounted along its axis, with for example a pulse tube and a compressor piston mounted on the same axis.

A cryocooler has an annular compressor piston, with an inertance tube passing through a central hole in the piston.

According to an aspect of the invention, a cryocooler includes: a pulse tube; a regenerator; and a compressor. The compressor includes a compressor piston axially-aligned with the pulse tube, wherein movement of the piston pushes a working fluid through the regenerator and the pulse tube.

According to an embodiment of any paragraph(s) of this summary, the compressor piston is annular piston having a central hole therethrough.

According to an embodiment of any paragraph(s) of this summary, the cryocooler further includes a straight inertance tube segment, connected to the pulse tube and passing through the central hole, whereby the straight inertance tube segment is axially aligned with the compressor piston and the pulse tube.

According to an embodiment of any paragraph(s) of this summary, the cryocooler further includes a coil of tubing attached to an end of the straight inertance tube segment that is opposite the pulse tube.

According to an embodiment of any paragraph(s) of this summary, the cryocooler further includes a balancer that is operatively coupled to the compressor piston to move in an opposite direction from the compressor piston, to balance forces produced by movement of the compressor piston.

According to an embodiment of any paragraph(s) of this summary, the balancer is actively controlled.

According to an embodiment of any paragraph(s) of this summary, the balancer is operatively coupled to an actuator to move the balancer axially.

According to an embodiment of any paragraph(s) of this summary, the actuator includes a voice coil actuator.

According to an embodiment of any paragraph(s) of this summary, the cryocooler further includes a controller operatively coupled to the actuator, to control movement of the balancer through control of the actuator.

According to an embodiment of any paragraph(s) of this summary, the cryocooler further includes a vibration sensor operatively coupled to the controller.

According to an embodiment of any paragraph(s) of this summary, the vibration sensor includes a load cell.

According to an embodiment of any paragraph(s) of this summary, the vibration sensor includes an accelerometer.

According to an embodiment of any paragraph(s) of this summary, the balancer is passively controlled.

According to an embodiment of any paragraph(s) of this summary, the balancer is axially aligned with the compressor piston and the pulse tube.

According to an embodiment of any paragraph(s) of this summary, the cryocooler further includes an inertance tube, connected to the pulse tube and passing through a central hole of the balancer.

According to an embodiment of any paragraph(s) of this summary, at least part of the balancer is radially within the compressor piston.

According to an embodiment of any paragraph(s) of this summary, the cryocooler further includes balancer flexure stacks mechanically connected to the balancer and a housing of the cryocooler.

According to an embodiment of any paragraph(s) of this summary, the balancer flexure stacks include non-rotating balancer flexures.

According to an embodiment of any paragraph(s) of this summary, the cryocooler further includes compressor flexure stacks mechanically connected to the compressor and a housing of the cryocooler.

According to an embodiment of any paragraph(s) of this summary, the compressor flexure stacks include non-rotating compressor flexures.

According to an embodiment of any paragraph(s) of this summary, the cryocooler further includes a voice coil actuator operatively coupled to the compressor, to move the compressor axially.

According to another aspect of the invention, a method of operating a cryocooler according to an embodiment of any paragraph(s) of this summary, includes the steps of: moving the compressor piston of the cryocooler by oscillating the compressor piston along an axis of the compressor piston that is co-axial with the pulse tube of the cryocooler; and compensating for movement of the compressor piston by oscillation of the balancer that is co-axial with the compressor piston and the pulse tube, along the axis. The compensating includes adjusting movement of the balancer using feedback from a vibration sensor that senses vibration of the cryocooler, to actively control the balancer.

According to another aspect of the invention, a method of operating a cryocooler includes the steps of: moving a compressor piston of the cryocooler by oscillating the compressor piston along an axis of the compressor piston that is co-axial with a pulse tube of the cryocooler; and compensating for movement of the compressor piston by oscillation of a balancer that is co-axial with the compressor piston and the pulse tube, along the axis. The compensating includes adjusting movement of the balancer using feedback from a vibration sensor that senses vibration of the cryocooler, to actively control the balancer.

According to an embodiment of any paragraph(s) of this summary, the adjusting movement of the balancer includes perturbing, based on the feedback, a signal sent to a balancer actuator that drives the balancer To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A pulse-tube cryocooler includes a compressor piston that is axially aligned with a pulse tube. The compressor piston is an annular piston that has a central hole around its axis. An inertance tube, connected to one end of the pulse tube, runs through the central hole in the compressor piston. The cryocooler also includes a balancer that moves in opposition to the compressor piston, to offset the forces in moving the compressor piston. The balancer may also be axially aligned with the pulse tube, the annular piston, and the inertance tube. The alignment of the compressor piston, the pulse tube, and the inertance tube aligns the forces produced by movement of fluid within the cryocooler. This makes it easier to cancel mechanical forces produced by the cryocooler in operation, since all (or most) of the forces are in a single axial direction. The forces may be canceled by the balancer, for example using active control of the balancer. This may be done using a controller operatively coupled to a balancer actuator that controls movement of the balancer, using input from one or more vibration sensors, such as load cells or accelerometers, that are attached to the cryocooler or otherwise mechanically coupled to the cryocooler so as to detect movements of the cryocooler, and provide feedback to the controller. The cryocooler also provides an integrated unit that includes the compressor, as well as a pulse tube and regenerator (parts of a "cold finger" of the cryocooler). This integrated configuration simplifies mounting of the cryocooler, among other benefits.

Figure 1:
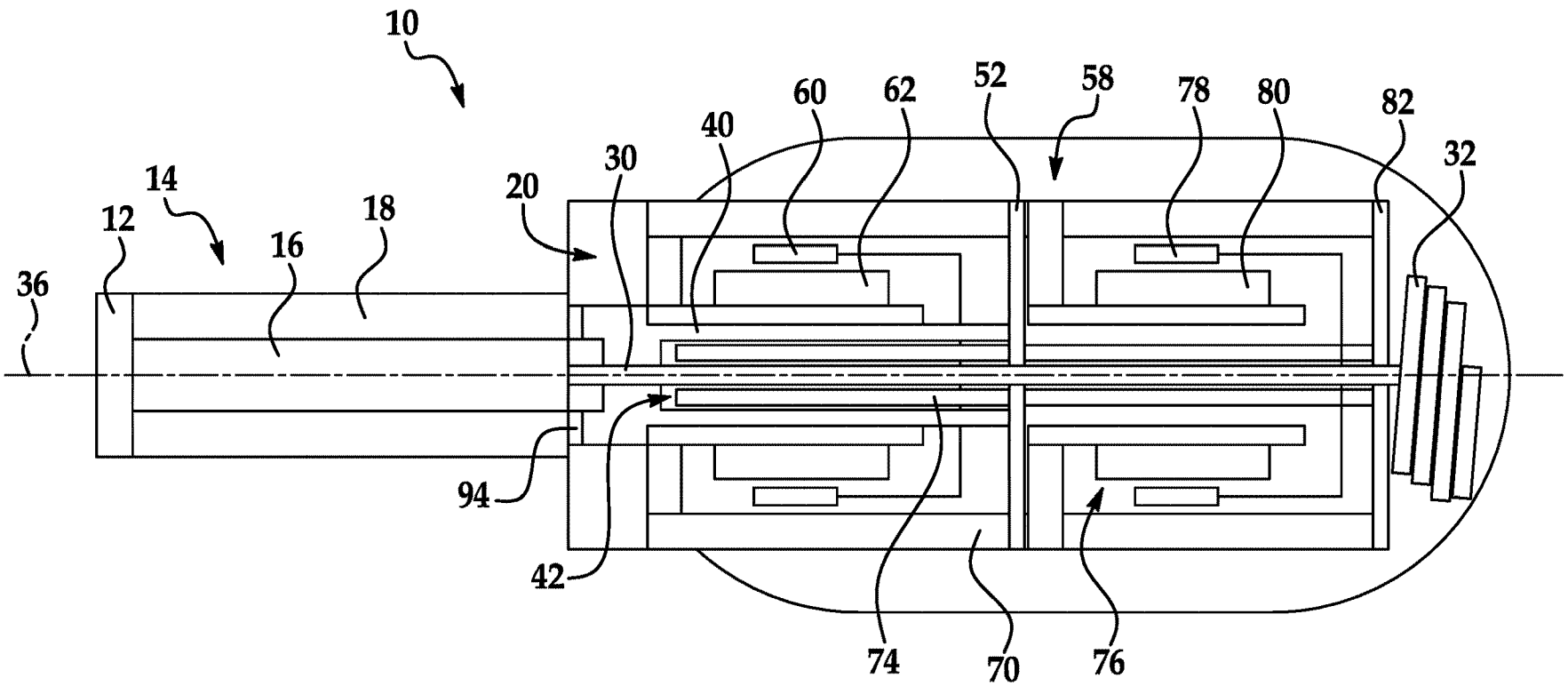
FIG. 1 is side sectional schematic view of a cryocooler according to an embodiment of the invention.

FIG. 1 shows a cryocooler 10 that produces cooling at a cold tip 12 that is at the end of a cold finger 14 that also includes a pulse tube 16 and a regenerator 18. The regenerator 18 is operatively coupled to a compressor 20 that circulates working fluid back and forth through the regenerator 18, and thereby back and forth through the pulse tube 16 as well.

A straight inertance tube segment 30, which is connected to a coiled inertance tube segment 32, is at an end of the pulse tube 16 that is opposite the cold tip 12. The straight inertance tube 30 is along a central longitudinal axis 36 of the cryocooler 10, co-axial with a number of the other components of the cryocooler 10, such as the pulse tube 16, the regenerator 18, the cold tip 12, and components of the compressor 20, such as a compressor piston 40. The compressor piston 40 in the illustrated embodiment is an annular piston, with the straight inertance tube 30 running through a central hole 42 in the compressor piston 40. This arrangement of components along the same central longitudinal axis 36 aids in controlling vibrations from the cryocooler 10, as described further below.

The coiled inertance tube 32 in the illustrated embodiment is an extension of the straight inertance tube segment 30. Alternatively the extension of the straight inertance tube 30 may have a different configuration. For example the extension could include parallel, counter-wound inertance tubes to avoid torques generated by the moving gas. A reservoir volume may be attached to an end of the inertance tube that includes the segments 30 and 32.

The compressor 20 includes the compressor piston 40 and a flexure stack 52, which is representative of what may be multiple flexure stacks supporting the piston 40. Movement of the compressor piston 40 and the compressor flexure stack 52 is controlled by a compressor actuator 58, which moves the compressor piston 40 back and forth in the axial (longitudinal) direction (oscillator movement). In the illustrated embodiment the compressor actuator 58 is a voice coil 60 that acts in conjunction with a permanent magnet 62. As an alternative to the illustrated voice coil arrangement, a moving magnet architecture could be used where the coil is stationary and the magnet is attached to the moving compressor piston. The compressor flexures in the flexure stack 52 are fixed at their outer ends to a suitable stationary structure within a hermetically-sealed housing 70. The piston 40 is coupled to inner openings of the compressor flexure stack 52.

A balancer 74 is used to balance out forces from the movement of the compressor 20. The balancer 74 is also co-axial with other parts about the longitudinal axis 36. The balancer 74 may be actively controlled, with its motion controlled by a balancer actuator 76, which may include a voice coil 78 that acts in conjunction with a permanent magnet 80. Other sorts of mechanisms that use a magnet may be used as alternatives. The balancer 74 is attached to inner openings of balancer flexure in a flexure stack 82, which may be representative of multiple flexure stacks used to support the balancer 74. The outer ends of the balancer flexure stack 82 are attached to the housing 70, or a stationary structure within the housing 70.

The balancer 74 moves back and forth in the longitudinal direction, with the balancer 74 generally moved opposite in direction from the compressor piston 40. This balances out the overall forces and vibrations due to moving parts of the cryocooler 10. As described further below, the active control of the balancer 74 may vary the movement of the balancer 74 in order to better cancel out the net forces/vibrations resulting from movement of the compressor piston 40 (and other moving parts of the cryocooler 10, including forces from the back-and-forth movement of the working fluid), for example varying the amplitude and or phase lag of the movement of the balancer 74.

Figure 2:
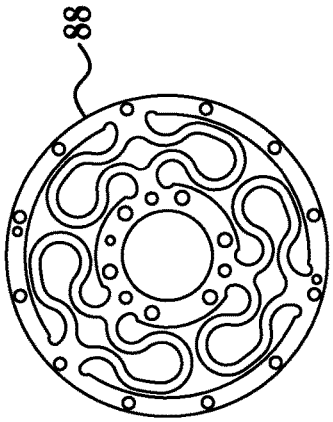
FIG. 2 is a plan view of a flexure usable as part of the cryocooler of FIG. 1.

The flexures in the compressor flexure stack 52 and the balancer flexure stack 82 may be non-rotating flexures, flexures that do not impart a radial force as they flex. An example of such a flexure is the flexure 88 shown in FIG. 2. Further descriptions regarding such flexures may be found in co-owned US Patent Publication 2015/0041619 A1, the drawings and description of which are incorporated herein by reference. Unlike for spiral flexures, flexures such as the non-rotating flexure 88 do not impart a significant rotational motion or torque.

The flexures in the flexure stacks 52 and 82 may all have the same (or substantially the same) configuration. Alternatively some or all of the flexures in the stacks 52 and 82 may have different configurations.

Helium (or another suitable working fluid) may be used as the working fluid of the cooler 10, sealed within the housing 70. Movement of the piston 40 drives the helium through holes in an insert that contains a working volume (compressor space) 94 acted on by the piston 40. The working fluid moves from the insert holes through holes in a manifold that is part of the housing 70. From the manifold holes the working fluid moves through the regenerator 18, through the cold tip 12, and back through to the pulse tube 16. As the piston 40 moves periodically back and forth the working gas also oscillates back and forth through the system, and the pressure within the system increases and decreases. The gas from the working volume 94 enters the regenerator 18 with a high temperature $T_{HIGH}$, and leaves the regenerator 18 at the cold end with a low temperature $T_{LOW}$. Thus heat is transferred into the material of the regenerator 18. On its return (when the piston 40 draws working gas back into the working volume 94) the heat stored within the regenerator 18 is transferred back into the working gas.

The cold temperature is at the cold tip 12, where a heat load (not shown) may be attached (or thermally coupled) for cooling. This heat load may be any of a variety of suitable objects to be cooled, such as sensor systems, optical systems, space systems, or superconductors, among other possibilities.

Figure 3:
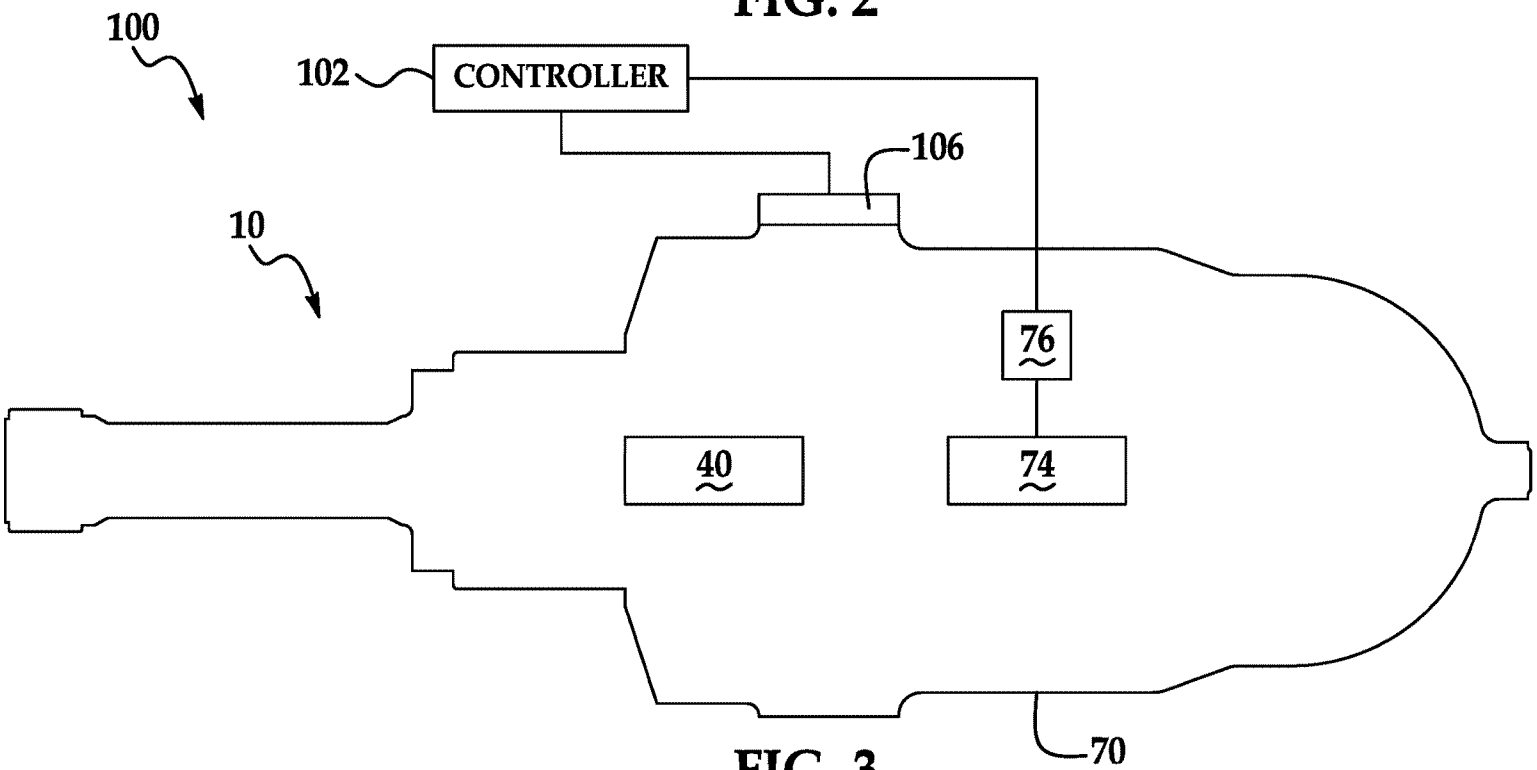
FIG. 3 is a schematic view of a control system that is part of the cryocooler of FIG. 1.

With reference now to FIG. 3, a control system 100 is shown for controlling the balancer 74 by sending appropriate signals for control of the balancer actuator 76. The control system 100 includes a feedback loop in which a controller 102 receives signals from a vibration sensor 106, such as a load cell or accelerometer. The vibration sensor 106 may be located on the cryocooler 10, such as on the housing 70, as is illustrated in FIG. 3. Alternatively the vibration sensor 106 may be located elsewhere, such as on structure (not shown) used to mount the cryocooler 10, between the cryocooler 10 and the mounting structure, or at other nearby objects or structure.

The vibration sensor 106 is used to measure vibration or imbalances produced by the combined movement of the moving parts of the cryocooler 10 (principally the piston 40 and the balancer 74). The controller 102 alters the operation of the balancer actuator 76 to minimize the vibration produced by the cryocooler 10. For example the cryocooler 10 with its active, controlled balancer 74, may be able to achieve exported disturbances (vibrations) on the order of 50 millinewtons.

The controller 102 may include any of a variety of suitable electronic elements, for example being or including an integrated circuit or processor, and may include hardware and/or software for carrying out the function of controlling the driving of the balancer 74 so as to minimize vibration. The feedback from the vibration sensor 106 may be used to perturb a signal sent to the balancer actuator 76 for driving the balancer 74. For example the compressor piston 40 may be driven using a sine wave provided to the compressor actuator 58 (FIG. 1), with an inverse of the sine wave provided as the base signal to the balancer actuator 76. The signal to the balancer actuator 76 may then be perturbed based on the feedback provided to the controller 102 by the vibration sensor 106.

As an alternative to the active control system 100 described above, the balancer 74 may instead be passive, moving passively in response to movement of the compressor piston 40. Such passive control may be used in situations where providing a low level of vibration and imbalance is not critical.

The cryocooler 10 may operate at any of a variety of suitable frequencies. The frequency may be 67 Hz, or may be more broadly 50-80 Hz, to give non-limiting examples.

The cryocoolers described above may provide several advantages relative to prior pulse tube cryocoolers. The cryocoolers described herein may have a more compact package, and allow for use of a single module, to be mounted on a single bracket or other mounting structure.

The placement of the pulse tube, the balancer, and the piston all on a single axis may constrain any potential imbalance, making it easier to detect imbalances and cancel such imbalances out, using feedback to cancel out imbalance forces. In prior systems that do not have these components on a common axis, there may be a need for multiple balancers or compensators for every axis in order to cancel out forces.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A cryocooler comprising:

a pulse tube;

a regenerator; and a compressor;

wherein the compressor includes a compressor piston axially-aligned with the pulse tube, wherein movement of the piston pushes a working fluid through the regenerator and the pulse tube; and wherein the compressor piston is annular piston having a central hole therethrough.

2. The cryocooler of claim 1, further comprising a straight inertance tube segment, connected to the pulse tube and passing through the central hole, whereby the straight inertance tube segment is axially aligned with the compressor piston and the pulse tube.

3. The cryocooler of claim 2, further comprising a coil of tubing attached to an end of the straight inertance tube segment that is opposite the pulse tube.

4. The cryocooler of claim 1, further comprising a balancer that is operatively coupled to the compressor piston to move in an opposite direction from the compressor piston, to balance forces produced by movement of the compressor piston.

5. The cryocooler of claim 4, wherein the balancer is actively controlled.

6. The cryocooler of claim 4, wherein the balancer is axially aligned with the compressor piston and the pulse tube.

7. The cryocooler of claim 6, further comprising an inertance tube, connected to the pulse tube and passing through a central hole of the balancer.

8. The cryocooler of claim 4, wherein at least part of the balancer is radially within the compressor piston.

9. The cryocooler of claim 4, further comprising balancer flexure stacks mechanically connected to the balancer and a housing of the cryocooler.

10. The cryocooler of claim 9, wherein the balancer flexure stacks include non-rotating balancer flexures.

11. The cryocooler of claim 1, further comprising compressor flexure stacks mechanically connected to the compressor and a housing of the cryocooler.

12. The cryocooler of claim 11, wherein the compressor flexure stacks include non-rotating compressor flexures.

13. A cryocooler comprising:

a pulse tube;

a regenerator; and a compressor;

wherein the compressor includes a compressor piston axially-aligned with the pulse tube, wherein movement of the piston pushes a working fluid through the regenerator and the pulse tube;

further comprising a balancer that is operatively coupled to the compressor piston to move in an opposite direction from the compressor piston, to balance forces produced by movement of the compressor piston;

wherein the balancer is actively controlled; and wherein the balancer is operatively coupled to an actuator to move the balancer axially.

14. The cryocooler of claim 13, further comprising a controller operatively coupled to the actuator, to control movement of the balancer through control of the actuator.

15. The cryocooler of claim 14, further comprising a vibration sensor operatively coupled to the controller.

16. A method of operating the cryocooler of claim 1, the method comprising:

moving the compressor piston of the cryocooler by oscillating the compressor piston along an axis of the compressor piston that is co-axial with the pulse tube of the cryocooler; and compensating for movement of the compressor piston by oscillation of the balancer that is co-axial with the compressor piston and the pulse tube, along the axis;

wherein the compensating includes adjusting movement of the balancer using feedback from a vibration sensor that senses vibration of the cryocooler, to actively control the balancer.

17. A method of operating a cryocooler, the method comprising:

moving a compressor piston of the cryocooler by oscillating the compressor piston along an axis of the compressor piston that is co-axial with a pulse tube of the cryocooler; and compensating for movement of the compressor piston by oscillation of a balancer that is co-axial with the compressor piston and the pulse tube, along the axis;

wherein the compensating includes adjusting movement of the balancer using feedback from a vibration sensor that senses vibration of the cryocooler, to actively control the balancer; and wherein the adjusting movement of the balancer includes perturbing, based on the feedback, a signal sent to a balancer actuator that drives the balancer.

* * * * *